United States Patent [19]

Cherry

[11] 4,291,598

[45] Sep. 29, 1981

[54] BRAKE APPARATUS FOR POWER WRENCH

[75] Inventor: Gary D. Cherry, Houma, La.

[73] Assignee: Sladco, Inc., Eunice, La.

[21] Appl. No.: 67,887

[22] Filed: Aug. 20, 1979

[51] Int. Cl.[3] ..... B25B 17/00

[52] U.S. Cl. ..... 81/57.15; 81/57.18; 188/77 R; 188/83

[58] Field of Search ..... 81/57.15, 57.16, 57.2, 81/57.21; 188/83, 77 R

[56] References Cited

U.S. PATENT DOCUMENTS

| | | | |
|---|---|---|---|
| 2,151,892 | 3/1939 | Brauer | 188/77 R |
| 2,646,081 | 7/1953 | Ritsky | 188/83 |
| 2,650,070 | 8/1953 | Lundeen | 81/57.18 |
| 2,989,880 | 6/1961 | Hesser et al. | 81/57.18 |

*Primary Examiner*—James L. Jones, Jr.
*Attorney, Agent, or Firm*—Charles C. Garvey, Jr.; Thomas S. Keaty

[57] ABSTRACT

An improved power tong brake apparatus provides an integral drum secured at a preferably integral mounting flange to the power tong jaw carrier. The drum has an exposed braking surface portion contacted during operation by a cooperating shoe which is adjustably attached to the tong housing.

8 Claims, 8 Drawing Figures

BRAKE APPARATUS FOR POWER WRENCH

BACKGROUND OF THE INVENTION

1. Field of the Invention

The present invention relates to an oil field apparatus or tool, and more particularly relates to an improved power wrench brake or drag assembly. Even more particularly, the present invention relates to an improved power wrench brake assembly providing an adjustable brake assembly having external, easily accessible brake drum surface and brake shoe portions which can be quickly field adjusted or field removed/replaced.

2. General Background and Prior Art

In the oil field and in oil/gas drilling, there is often utilized a "power wrench" or "power tong" for making up and braking up sections of drill pipe, casing, or other like piping assemblies which are generally made up into strings from a plurality of joints. Many of these power tongs or power wrenches are in use which quickly make or brake the desired connection using power supplied by an electric or hydraulic motor for example. Generally, power wrenches of this type have a clutch or drag or brake assembly which transforms rotary power through a gear reduction system into gripping power through a cam mechanism, thus allowing the pipe to be gripped at the joint and the desired torque applied. Power wrenches and power tongs of this type are known.

The clutch or drag assembly of a power wrench requires adjustment. This is because the frictional contact between a drum surface and a shoe surface to one or both. Further, adjustment of the drag assembly makes a great deal or torque or a lesser amount of torque (as desired) transferable directly to the gripping jaws of the power wrench. In other words, whether or not the frictional engagement of the drag assembly is great or small determines at least to some extent the force with which the pipe joint will be gripped. The adjustment must be maintained over a long period of time during the drilling operation. As wear occurs on the shoe and/or drum, adjustments must be made to assure the same gripping strength to the pipe. Generally the brake mechanism is internal to the wrench and cannot be adjusted in the field. Adjustment with internal brake assemblies must be performed by a shop mechanic or other technical person who inspects the wrench and readies it for operation at a shop or other site, usually removed from the actual drilling location. Often a portion of the wrench itself must be disassembled to gain access to the brake assembly for replacement/adjustment.

Other prior art type clutch assemblies recommend and teach that a duplicate clutch assembly or drag assembly or brake assembly be kept in the field with the tool to replace the original assembly since field adjustment is impossible or at least very difficult. With such assembly, the shoe and drum are a single unit, with adjustment on the entire unit being possible but when outside the wrench.

When a driller is required to spend excessive down time on the adjustment of a particular part of his drilling equipment, very expensive down time results which loses production for the driller desirous of completing a drilling of the well. Needless to say, time is money and the driller as well as all other persons connected with the drilling of the well desire that it be completed as soon as possible with as little down time to the equipment as possible.

Several devices have been patented which address the concept of a brake or drag apparatus for a power tong. U.S. Pat. No. 2,618,468 issued to C. A. Lundeen and entitled "Power Tong", shows a brake rim and a cooperating stationary brake band.

In U.S. Pat. No. 4,015,661 entitled "Apparatus for Coupling and Uncoupling Pipe Sections", there is shown a pair of brake members which function as a brake apparatus for a power tong.

In U.S. Pat. No. 2,650,070 issued to C. A. Lundeen, there is also seen a friction band having a lining which encircles an upright rim.

U.S. Pat. No. 3,141,362 issued to Simon Tammy and Zenis Weisel provides a "Jaw Operating Structure for a Power Operated Wrench". A annular brake pad 61 is provided with a cooperating drum structure.

U.S. Pat. No. 3,516,308 issued to J. E. Ham and Merrill Willsey provides a power tong transmission assembly which shows a brake band engaged with an annular wall. Further provided with the Ham-Willsey device is a means for applying more or less braking force to the band designated as a brake actuator mechanism.

U.S. Pat. No. 3,540,326 issued to J. L. Dickman provides a "Pipe Tong Head". This patent is also discussed in U.S. Pat. No. 3,516,308.

U.S. Pat. No. 3,589,742 issued to Howard S. Flick and entitled "Jaw Actuating Means for Pipe Tongs" provides a brake band having an inner lining which cooperates with a drum structure.

U.S. Pat. No. 3,625,095 issued to James Barnett provides a brake means for use with power tongs.

U.S. Pat. No. 3,380,323 issued to A. B. Campbell and entitled "Power Wrench" illustrates a braking structure which is comprised of flat annular disc like braking elements. The Campbell device also utilizes as a preferred means for braking a drum and brake shoe structure.

These and other prior art type brake devices for use with power wrenches and power tongs are generally hard to regulate, and are hard to replace. Many are deep within the housing of the wrench or power tong and require a disassembly of the wrench and order that they be adjusted and/or replaced. Further, many of the above devices have no adjustability with respect to the brake shoe and brake drum portions, thus having no way to adjust the torque applied by the wrench or to compensate for wear or either the brake or drum structure. At least one device above (U.S. Pat. No. 3,516,308) does provide an adjuster screw, which can be adjusted to get more or less braking force to the tong assembly. However, in that patent to J. E. Ham and Merrill Willsey, the adjustable screw is unbalanced and difficult to adjust. Further, the entire assembly is not freely available for inspection and/or replacement.

Most prior art devices are difficult and/or impossible to replace in the field should the need arise. Further, they are plagued by the problem of adjustability of the frictional contact of the drum and shoe during operation of the wrench. Further, they often require extensive use of extra tools to precisely vary the torque provided by the wrench through the braking assembly if such adjustability is available at all.

Those devices which have braking members which are within the housing of the wrench usually require shop maintenance removed from the site of the use of the tong in order to properly repair, replace, and/or adjust the braking apparatus.

3. General Description of the Present Invention

The present invention provides an improved power tong brake apparatus which utilizes a preferably integral brake drum body provided with an outer bearing surface. The brake drum body is affixed to the power tong at the jaw carrier portion thereof with the bearing surface portion of the brake drum body projecting externally to the outside of the power tong housing when affixed thereto during operation.

An adjustable brake shoe adapted for frictional engagement with the brake drum is provided and also externally mounted on the outer frame portion of the power tong with the shoe being movably adjustable on the power tong frame with respect to the drum.

In the preferred embodiment, the brake drum is an integral single body having a downwardly depending cylindrical drum portion provided with an outer curved drum bearing surface. The drum surface is entirely external to the power tong itself and thus easily accessible by a driller, repairman, or other technical person when adjustment is required. The brake shoe can be for example, semi-circular in structure and attaches to the external portion of the power tong frame and registers with and contacts frictionally the brake drum at its outer circular bearing surface. The brake shoe is provided with an external adjustment which allows it to be quickly and easily moved and adjusted with respect to the brake drum surface minimizing down time, minimizing repair time, and maximizing production of the oil well or other installation to which the entire power tong apparatus is assigned.

Therefore it is an object of the present invention to provide an improved power tong brake apparatus which is generally external to the power tong allowing easy access thereto.

It is another object of the present invention to provide an adjustable power tong brake apparatus which is generally externally adjustable and easily adjustable in the field where the power tong is being utilized.

It is further object of the present invention to provide a power tong brake apparatus which is simple in structure and simple to manufacture, and requiring little maintenance.

It is another object of the present invention to provide a power tong brake apparatus providing a semi-circular brake shoe, which is externally mounted to the power tong and is externally adjustable on the power tong with respect to the brake drum.

A feature of the present invention is that it can be externally adjusted with conventional tools in the field at the site of the oil well, gas well, or other installation or job to which the power tong is being used.

Another feature of the present invention is that it provides a power tong brake apparatus which includes a brake drum and brake shoe, which are mutually separate parts that can be individually changed without the changing of the other part associated therewith.

Brief Description of the Drawings

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
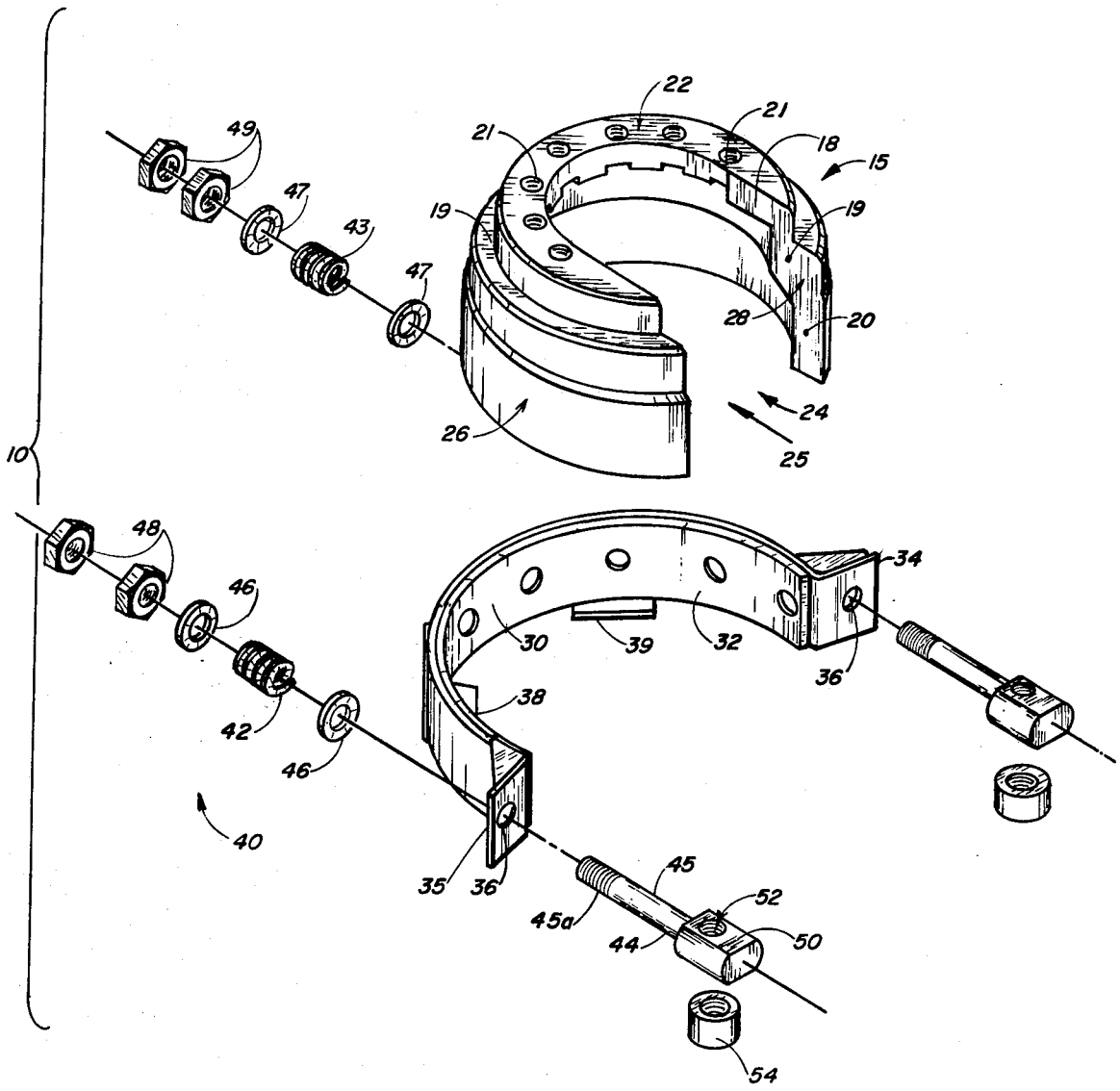
FIG. 1 is a perspective exploded view of the preferred embodiment of the apparatus of the present invention showing with particularity the brake body and brake band portions thereof.

FIG. 1 best shows the preferred embodiment of the apparatus of the present invention designated by the number 10 in FIG. 1. Brake apparatus 10 comprises generally a brake body 15 and a cooperative brake shoe 30. Brake body 15 provides an upper mounting plate 18, a transitional integral shoulder section 19, and a lower brake drum section 20 having an outer braking surface 26 which in operation frictionally engages brake shoe 30. Brake body 15 moves during operation with the jaw carrier portion of a typical power tong 70. Brake shoe 30 mounts to power tong housing 60 in an adjustable fashion with tensioners 40 allowing frictional pressure of brake shoe 30 against brake body 15 to be regulated as will be discussed more fully hereinafter.

Figure 2:
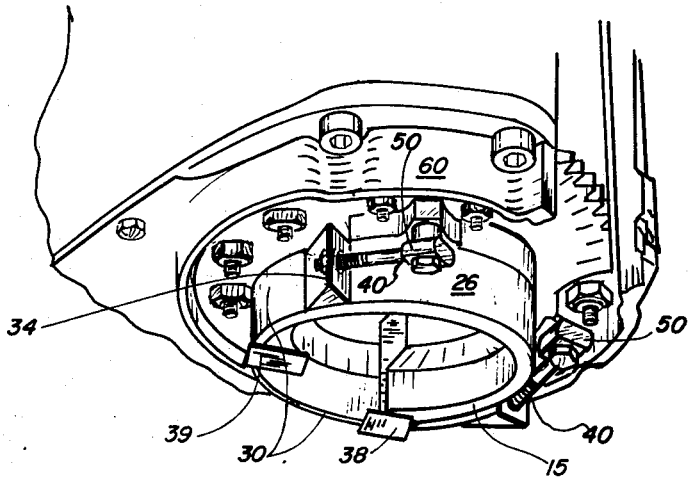
FIG. 2 is a fragmentary view of a typical prior art type power wrench with the brake apparatus of the present invention affixed thereto.
Figure 3:
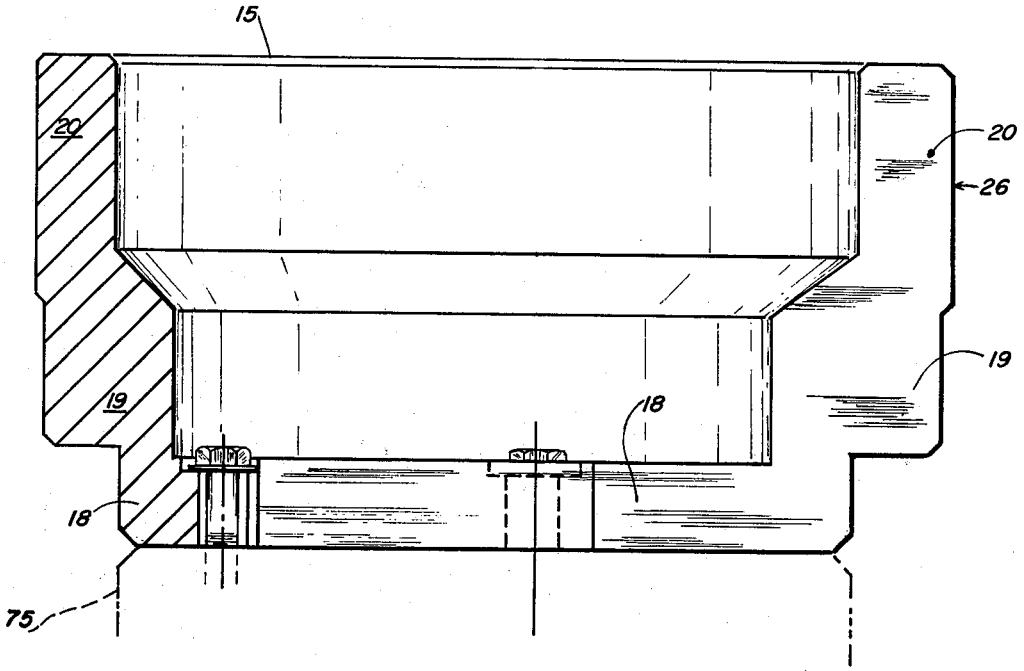
FIGS. 3–3A are sectional views of the brake body portion of the preferred embodiment of the apparatus of the present invention attached to a typical conventional power tong jaw carrier assembly.
Figure 3A:
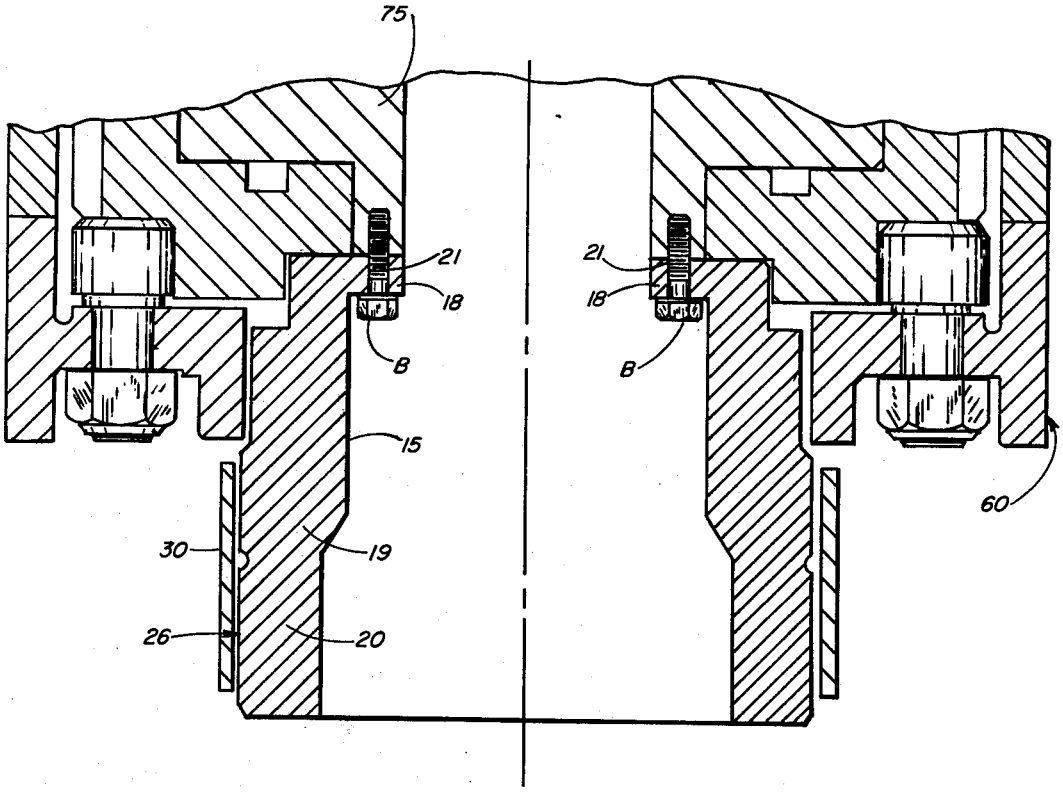

The construction of brake body is best shown in FIGS. 1, 3 and 6–7. The attachment of brake body 15 to jaw carrier assembly 75 is for example a bolted connection as shown in FIGS. 3–3A at upper mounting plate 18 through openings 21. In operation, body 15 would be inverted from the position shown in FIG. 3. Proper operating position is shown in FIG. 2.

Upper mounting plate 18 provides a plurality of mounting openings 21 through which suitable connection members, such as threaded bolts, can be passed for attachment brake body 15 to a conventional power wrench, designated generally by the numeral 70 in FIGS. 2 and 3A. In practice, brake body 15 will be attached at upper mounting plate 18 to the lower portion of power wrench 70 at the jaw carrier assembly 75 portion thereof. FIG. 3 shows brake body 15 mounted on a conventional jaw carrier assembly 75, shown partially in phantom lines. FIGS. 8–10 of U.S. Pat. No. 3,380,323 describe such a bolted attachment of a prior art brake means to the jaw carrier of the power wrench. FIG. 3A shows in section, brake body 15 attached to power wrench 70 of the type seen in U.S. Pat. No. 3,380,323. In FIG. 3A, brake body 15 can be seen attached by bolts B to jaw carrier 75. As with the prior art type brake of U.S. Pat. No. 3,380,323, the present invention would preferably provide one bolt B for each opening 21 in brake body 15. Throat 25 of brake body 15 would correspond to the radial throat provided in housing 60 of power tong 70. A typical power wrench 70 or "power tong" as it is referred to in the oil industry, can be seen in U.S. Pat. No. 3,380,323 issued to A. B. Campbell on Apr. 30, 1968 incorporated herein by reference. Such a power tong 70 is manufactured by Joy Petroleum Equipment under the trademark "Hillman-Kelly". Joy Petroleum Equipment Manual number 500 C-477 which further specifies the operation of a conventional "Power Tong" is incorporated herein by reference.

The transitional section 19 or shoulder section of brake body 15 can be attached integrally to the lower brake drum section 20. Mounting plate 18 provides a mounting plate surface 22, which abuts the jaw carrier 75 assembly portion of power wrench 70 during operation (see FIG. 3). Brake body 15 is thus generally cylindrical in construction.

Figure 7:
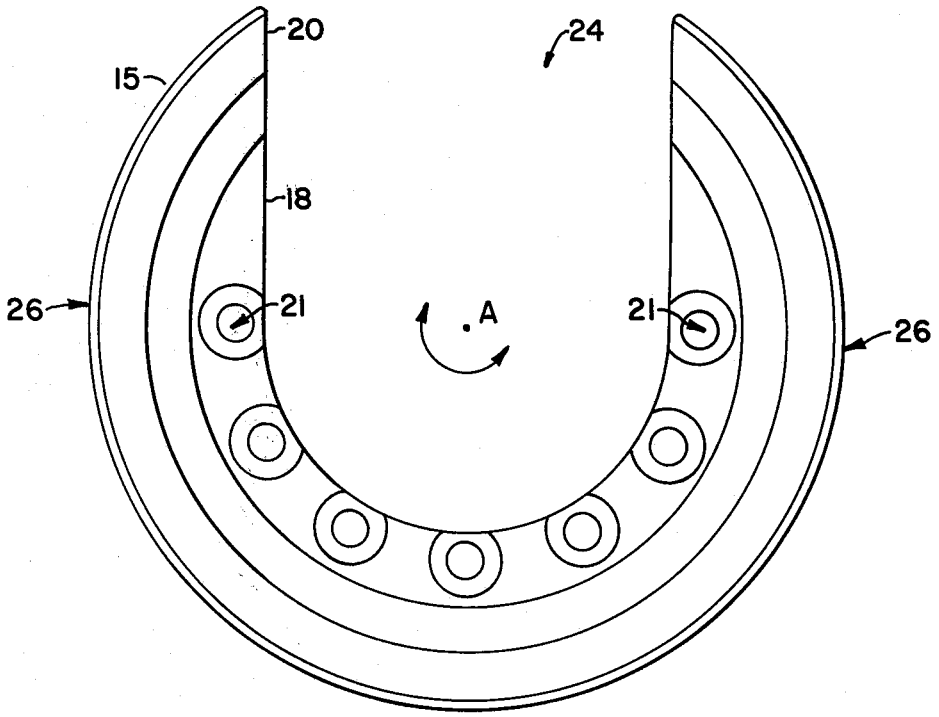
FIG. 7 is a top view of the brake body portion of the preferred embodiment of the apparatus of the present invention.

Brake body 15 also provides a gap or throat 24 portion which allows the entry of drill pipe (not shown) to the inner portion of power wrench 70, where drill pipe can be engaged or disengaged as the case may be as is known in the power tong art. Throat 24 is U-shaped as seen in FIG. 7. Arrow 25 in FIG. 1 indicates the path of entry of drill pipe (not shown) into the inner portion of brake body 15, passing throat side faces 28.

Figure 6:
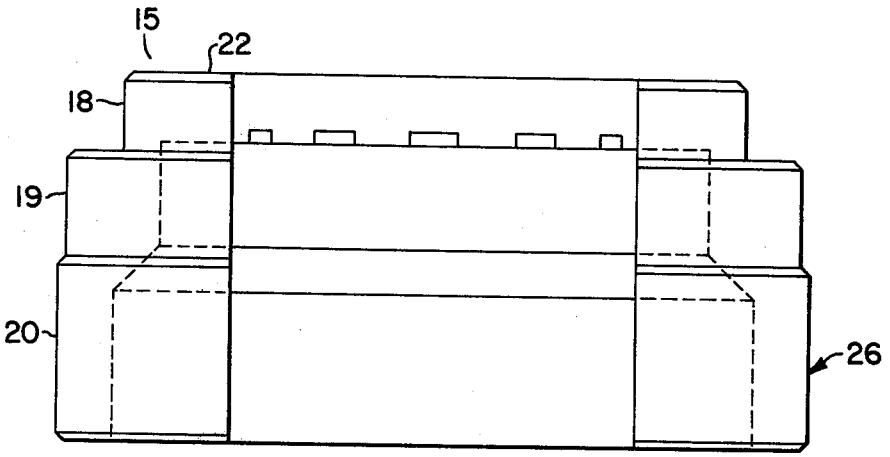
FIG. 6 is a front view of the brake body portion of the preferred embodiment of the apparatus of the present invention.

FIG. 3 presents a sectional view of brake body 15, including a view of the preferable integral connection of upper mounting plate 18, shoulder section 19, and lower brake drum section 20 having surface 26. It should be understood that upper mounting plate 18 can have a reduced diameter as shown adapted to engage the jaw carrier assembly 75 portion of the power wrench 70. Transitional section 19 integrally connects mounting plate 18 to brake drum section 20. Brake drum section 20 can be enlarged to abut brake shoe 30 during operation, as will be described more fully hereinafter. By manufacturing brake body 15 in such a three part manner, a brake body 15 can be tooled to fit any desired power wrench or power tong. Mounting plate 18 would be tooled to attach to and register with the jaw carrier assembly portion of the power wrench, with a bolted connection being exemplary and shown in FIGS. 3–3A. Existing threaded openings on jaw carrier 75 for the attachment of bolts thereto, or new threaded openings 21*a* can be tapped if required. After shoe 30 is sized to fit frame 60, drum surface 26 and drum portion 20 can be tooled to correspond therewith. Transitional section 19 structurally connects mounting plate and drum section 20. In operation, brake body 15 rotates about point A as shown in FIG. 7. Braking surface 26 is curved and as shown in FIGS. 6 and 7 is equidistant from axis of rotation A. Likewise, inner brake lining 32 is curved, and is preferably equidistant from the axis of rotation A of brake body 15. It will be appreciated that lining 32 and brake surface 26 will be substantially coincident during operation having equal radii of curvature, thus allowing frictional bearing to be uniformly distributed along the length of surface 26 and lining 32. Two tensioners 40 further contribute to the uniform braking friction along the length of band lining 32. The axis of rotation "A" of brake body 15 would be the same axis of rotation preferably of jaw carrier 75. Brake body 15 would rotate about axis A responsive to rotation of the jaw carrier 75 portion of power tong 70. Axis A would generally represent the center or central axis of a length of drill pipe or the like being held by power tong 70.

Figure 4:
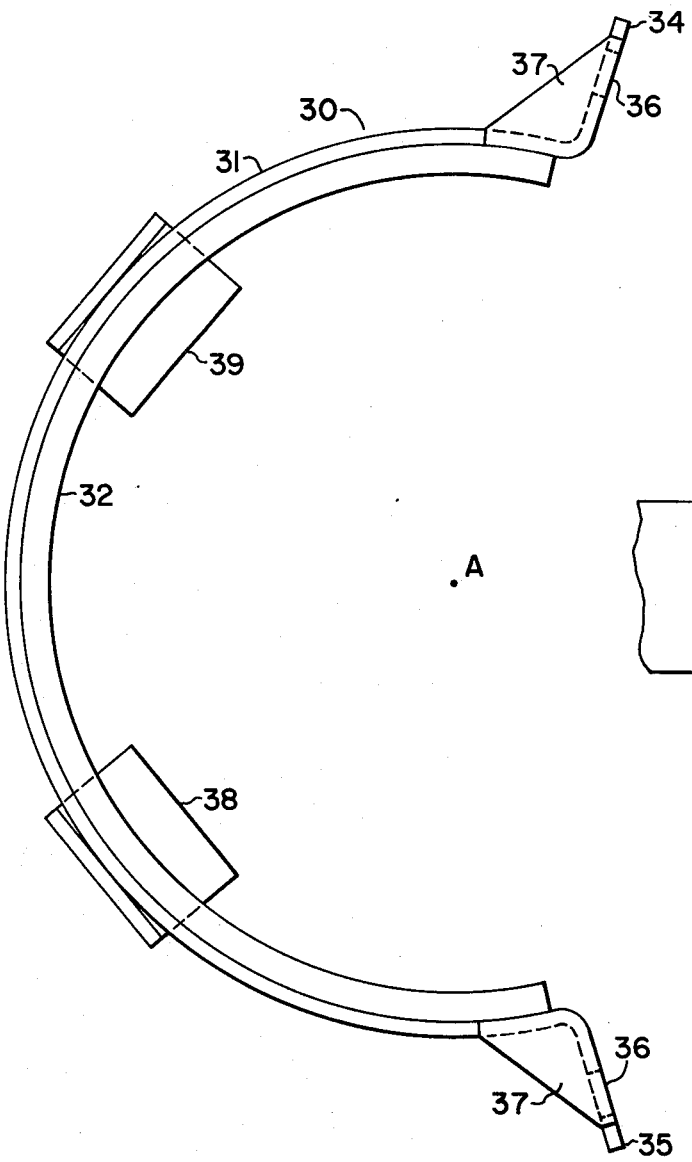
FIG. 4 is a detailed top view of the brake shoe portion of the preferred embodiment of the apparatus of the present invention.
Figure 5:
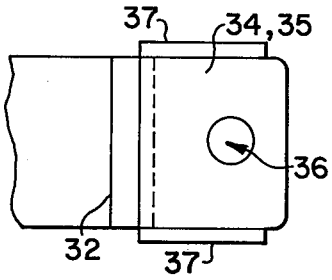
FIG. 5 is a fragmentary view of the brake shoe portion of the preferred embodiment of the apparatus of the present invention illustrating the mounting ear bracket portion thereof.

Brake shoe 30, (FIGS. 1 and 4, 5) is comprised of a brake band 31 and a brake band lining 32. Attachment ear brackets 34, 35 in cooperation with tensioners 40, as will be described more fully hereinafter, mount brake shoe 30 to the housing 60 portion of power tong 70, (see FIG. 2). Openings 36 in brackets 34, 35 allow suitable threaded members 44 to pass therethrough and make an adjustable compression attachment of shoe 30 to housing 60 of wrench 70. Gussets 37 reinforce ear brackets 34, 35 at their interconnection with band 31 which can be integral. Rivets (not shown) can be used to affix lining 32 to band 31. Keepers 38, 39 register shoe 30 with the drum 20 portion of brake body 15 at surface 26. The construction of tensioners 40 and more particularly threaded member 44 and compression springs 42 will be now described.

Tensioners 40 are comprised generally of threaded members 44, compression springs 42, 43 and bolts 48, 49. Tensioners 40 are used in operation to regulate the degree of bearing of brake shoe 30 upon the braking surface 26 portion of brake drum section 20 of brake body 15. It will be understood by one skilled in the art, that threaded adjustment of nuts 48, 49 upon threaded member 44 will vary the degree of friction which exists between braking surface 26 and brake shoe 30 at inner brake lining 32. It will be appreciated that shoe 30 can be adjusted as it wears and as the thickness of lining 31 changes to provide any desired frictional drag against drum surface 26. Likewise, wear at drum surface 26 can be so compensated. In operation, the spring 42, 43 and nut 48, 49 portions of tensioners 40 attach to threaded members 44 on the side of ear bracket 35 opposite mount 50.

Compression springs 42, 43 are mounted in operation on shaft 44 between washers 46, 47 and between nuts 48, 49 and ear barckets 34, 35. A biasing is thus provided of shoe 30 towards brake surface 26, (see FIG. 2), and into frictional engagement therewith.

Threaded member 44 comprises a threaded shaft 45 having threads 45*a*. Compression springs 42, 43 are sized to slideably fit over threaded shafts 45 during operation after shafts 45 pass through openings 36 of ear brackets 34, 35. Likewise, washer 46 is attached to threaded shaft 44 during operation on each side of compression springs 42 while compression spring 43 is sandwiched between washers 47 on a corresponding threaded shaft 44. Nuts 48, 49 complete the adjustable attachment as will be apparent to one skilled in the art.

Threaded members 44 further provide a mount 50 portion having mount openings 52 therethrough. Attachment of threaded member 44 to the housing 60 portion of power wrench 70 is achieved preferably by a temporary but firm connection, such as bolting, through mount opening 52 and spacing bushing 54 for example, (see FIG. 2). Frame 60 of wrench 70 could be tapped to receive a bolt 53 placed through opening 52. Alternatively, a threaded stud could be welded to frame 60 projecting outwardly, with opening 52 attaching to the stud. It will be understood by one skilled in the art that threaded member 44 will be firmly anchored to the housing 60 portion of power wrench 70 during operation, and housing 60 portion of power wrench 70 during operation, and frame 60 of wrench 70 will form a point for relative movement of brake shoe 30 to or from brake body 15 and braking surface 26. It will be understood by one skilled in the art that rotational movement of bolts 48, 49 upon shaft 44 will provide an "adjustment" or "compensation" to brake band 30 increasing or decreasing as desired the biasing of springs 42, 43 against band 30 and thus varying adjustably the lining frictional pressure and frictional bearing of brake band 32 against brake body 15.

During operation, brake body 15 will be affixed to the jaw carrier 75 portion of power wrench 70. As is apparent to one skilled in the art, with the conventional power tong 70, the direction of rotation of the rotor portion in either direction will allow the braking means 10, as taught by the present invention, to restrain the jaw portions against rotation to cause the cam portions of the tong to close the jaws on the drill string. Such operation is disclosed in the prior art patents, such as U.S. Pat. No. 3,380,323 as above incorporated by reference. It should be understood that the above described operation of power tong 70, the jaw members, the cam members, and the rotation of the tong rotor are presently known in the art.

The present invention thus provides an external adjustable braking arrangement which can be easily field adjusted by using a conventional tool such as a crescent wrench or socket wrench, or the like. The power wrench 70 does not need to be removed from its field of operation, but rather can be easily adjusted in the field by use of bolts 48, 49 and their threaded movement upon shafts 44. It will be understood by one skilled in the art, that brake shoe 30 can be easily removed and replaced when totally worn beyond adjustment. Notwithstanding the fact that shoe 30 can be removed, brake body 15 can remain in its bolted position upon jaw carrier 75. Brake body 15 can be a one piece integral member which can be easily machined from a single piece of metal such as carbon steel or stainless steel or like suitable brake drum material. Brake shoe 30 is a simple and inexpensive construction utilizing an outer brake band 31 manufactured of metal such as steel or the like, and an inner brake band lining 32 asbestos, or like brake band material, which can be riveted in place on band 31. Keepers 38, 39 (see FIGS. 1 and 2) register band 30 with brake body 15 and more particularly with brake drum section 20 and even more particularly with braking surface 26. In this way, it is assured that braking surface 26 will always be abutted by the lining 32 portion of band 30. Keepers 38, 39 can be welded to band 31.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

I claim:

1. A power tong brake apparatus comprising:

a. a power tong having a tong housing and at least an inner jaw carrier;

b. a brake body, said brake body being of rounded construction and having a throat portion which allows the entry of drill pipe, to be assembled or disassembled by the power tong, to be placed at the inner portion of said brake body, said brake body comprising:

i. a generally circular flange having a plurality of attachment openings spaced about the periphery thereof, said flange being fittable against the jaw carrier portion of said power tong and being attached thereto during operation;

ii. a cylindrical exposed brake drum projecting externally of said housing and providing a curved outwardly facing braking surface;

iii. a generally circular transitional section connecting said mounting flange and said brake drum;

c. a plurality of threaded bolts inserted respectively through said plurality of openings in said mounting flange and connecting by threading into the lower end of said jaw carrier;

d. a brake shoe attached during operation to said power tong housing adjacent said brake surface, said brake shoe surrounding said body and providing a frictional lining surface facing inwardly which registers with and frictionally contacts during operation at least a portion of said brake body at said braking surface;

e. tensioner means associated with said brake shoe and said power tong housing for adjusting clearance between said brake shoe and said brake body.

2. The power tong brake apparatus of claim 1, wherein said brake body is generally cylindrical providing a U-shaped throat portion.

3. The power tong brake apparatus of claim 1, wherein said tensioners comprise at least in part a threaded shaft, a compression spring member and at least one nut threaded to and adjustably movable along said shaft, with said spring member in operation abutting at one end portion said nut, and at its opposite end portion, said shoe.

4. The power tong brake apparatus of claim 1, wherein said brake shoe is generally semi-circular and comprises a brake band and brake lining, with said lining being provided on the inner portion of said brake band and during braking abutting the drum surface portion of said brake body.

5. The power tong brake apparatus of claim 1, wherein said brake shoe provides a pair of ear brackets attached to the end portions of said band, said ear brackets attaching said tensioners to said band.

6. The power tong apparatus of claim 1, wherein said tensioners are provided with compression springs for biasing said brake shoe into frictional engagement with said brake body.

7. The power tong brake apparatus of claim 1, wherein said tensioner means provide biasing means for biasing said shoe into frictional contact with said exterior drum surface.

8. A power tong brake apparatus comprising:

a. a power tong having at least a tong housing and a jaw carrier;

b. a brake body having means for attachment of said brake body to said jaw carrier and rotating therewith, said brake body comprising:

i. a cylindrical exposed brake drum projecting externally from said tong housing, said drum having a curved outer drum surface with a constant radius of curvature;

ii. a mounting plate having a plurality of openings therethrough, adapting said mounting plate for attachment by bolting to said jaw carrier;

iii. a transitional section integrally connecting said brake drum and said mounting plate;

b. a curved brake shoe comprising a curved brake band with an attached inner curved brake lining, said brake shoe and said drum surface having substantially equal radii of curvature and being generally coincident and in face-to-face frictional engagement during operation, said brake band providing an ear mounting bracket at each end portion thereof, each bracket being provided with an opening therethrough; and c. biasing tensioner means adapted for attachment to the power tong housing for biasing said brake shoe against said drum surface, said biasing means comprising a pair of tensioners associated respectively with said ear brackets, each of said tensioners providing a threaded shaft member passing during operation through said openings of said ear brackets respectively, and an adjustment nut and each of said shafts having means at one end portion for affixing said shaft member to the power tool housing, and being threaded to receive said adjustment nut at the opposite end portion thereof, said tensioner further having a compression spring member placed on said shaft between said ear bracket and said adjustment nut threadably mounted on said shaft, the rotation of said nut on said shaft varying the biasing of said spring against said ear bracket and thus the bearing of said shoe against said drum surface.

* * * * *